United States Patent [19]

Gray

[11] 4,103,631

[45] Aug. 1, 1978

[54] EMBROIDERY PUNCH

[76] Inventor: Sharon Mae Gray, Rte. 3, Box 166, Cheney, Wash. 99004

[21] Appl. No.: 798,792

[22] Filed: May 20, 1977

[51] Int. Cl.[2] ..... D05B 15/06

[52] U.S. Cl. ..... 112/80; 223/104

[58] Field of Search ..... 112/80, 78; 223/104, 223/102; 69/20; 12/103

[56] References Cited

U.S. PATENT DOCUMENTS

| | | | |
|---|---|---|---|
| 1,109,040 | 9/1914 | Carter | 112/80 X |
| 1,176,032 | 3/1916 | Cole | 112/80 |
| 2,097,380 | 10/1937 | Morgan | 112/80 |
| 2,319,442 | 5/1943 | Carlson | 112/80 |
| 2,565,135 | 8/1951 | Kittner | 112/80 |
| 2,610,598 | 9/1952 | Midas | 112/80 |
| 3,189,237 | 6/1965 | Wilfert | 112/80 X |

*Primary Examiner*—H. Hampton Hunter

*Attorney, Agent, or Firm*—Wells, St. John & Roberts

[57] ABSTRACT

A tool for hand embroidery work. The tool is specifically designed for loop embroidery where a pattern is constructed of loops of thread or embroidery floss formed on the opposite surface of a background fabric from the surface in which the needle is inserted. The loops may be cut or left uncut to form the finished texture and pattern. The tool includes an elongated hollow, open ended body with a hollow needle at one end thereof. The open interior of the needle openly communicates with the hollow body interior. The pointed end of the needle is similar in configuration to a hypodermic needle, having its point formed by a beveled surface. An aperture is formed through one side of the needle wall adjacent to the pointed tip thereof. A thread or floss section may extend through the overall length of the body and hollow needle, with the free end of the thread protruding through the aperture rather than through the point of the needle. The body is formed in two separable sections that facilitate storage of the punch in a compact configuration while also preventing damage to the needle.

3 Claims, 6 Drawing Figures

FIG. 1
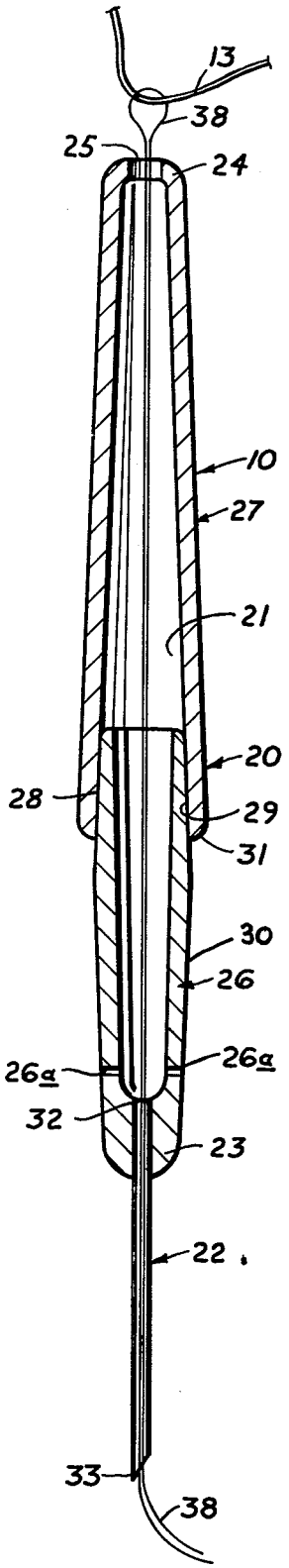
FIG. 2
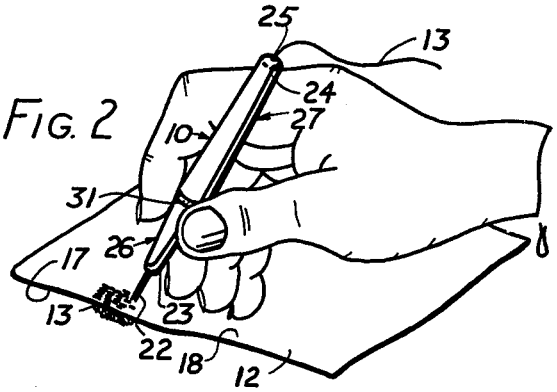
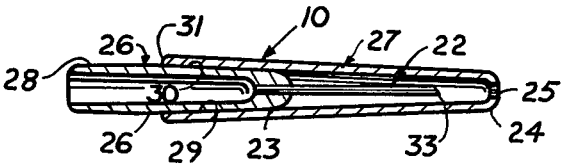
FIG. 3
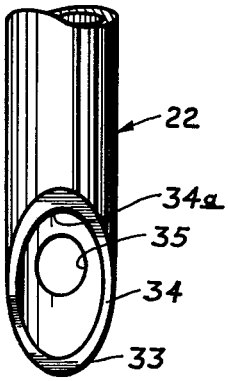
FIG. 5
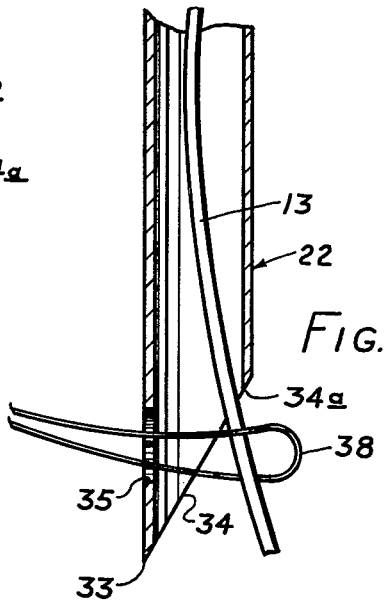
FIG. 4
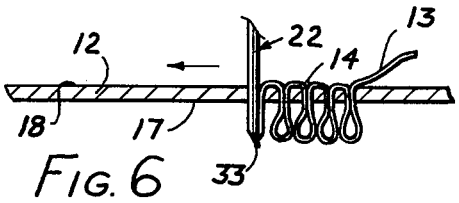
FIG. 6

EMBROIDERY PUNCH

BACKGROUND OF THE INVENTION

The present invention was developed for the purpose of performing loop embroidery in which the pattern is found on the face or "right" side of the background fabric by working the needle only on the "wrong" side or back side of the background fabric. Such embroidery is frequently referred to as "Russian" embroidery. Thus, the loops are formed on the right side while the embroiderer performs successive stitches without interference of the loops from the wrong side. Formation of each loop involves a single punching and retracting motion wherein the needle is driven through the fabric from the wrong side to a specified distance, then retracted completely from the fabric. The thread is pulled by the needle through the fabric (in the inward motion) and doubled over onto itself, as the needle is retracted, leaving a loop remaining on the right side of the fabric. Numerous successive loops may be made of exactly equal dimension as determinable by the length of the needle.

It is therefore a primary object of the present invention to provide a punch embroidery needle that will simplify and expedite previously slow embroidery procedures.

A further object is to provide such a device wherein the embroiderer may work effectively from the "wrong" side of the background fabric to avoid interference by the loops formed on the opposite "right" side.

A still further object is to provide such a tool that is convertible from a storage condition wherein the needle thereof is enclosed and protected by a portion of the tool body when in the storage condition and includes a comfortable hand held barrel portion when the tool is assembled in an operating condition.

A still further object is to provide such a tool that is relatively simple in construction and may therefore be manufactured and sold at a low cost.

These and still further objects and advantages will become apparent upon reading the following detailed description which, taken with the accompanying drawings, disclose a preferred form of the present invention. It should be noted however, that the following description is not given to restrict the scope of my invention and that modifications not shown in the drawings or discussed in the specification may be made without departing from the scope of my invention. Therefore, only the claims that are found following the specification are to be taken as restrictions upon the scope of what I specifically regard as my invention.

BRIEF DESCRIPTION OF THE DRAWINGS

FIG. 1 is an enlarged longitudinal sectioned view of the present embroidery punch;

FIG. 2 is a view illustrating the present invention in operation;

FIG. 3 is a substantially full scale view showing the present punch in a storage condition;

FIG. 4 is an enlarged fragmentary section view of the needle tip of my invention;

FIG. 5 is an enlarged fragmentary view of the tip as seen from the right in FIG. 4; and FIG. 6 is a diagrammatic view illustrating the operating principles of the present invention.

DETAILED DESCRIPTION OF A PREFERRED EMBODIMENT

The present punch is illustrated in the accompanying drawings and is designated therein by the reference character 10. Punch 10 is utilized in an embroidery process to form a variation of the embroidery stitch frequently called "Russian" embroidery. The punch operates on typical forms of background fabric 12 and receives ordinary embroidery floss or thread such as shown at 13. The product produced through use of the present punch 10 is exemplified by the diagrammatic stitches shown at 14 in FIG. 6. The advantages of using the punch 10 in the formation of the stitches shown at 14 is a substantial savings of time as compared to traditional techniques and lack of frustration ordinarily accompanying such work when it must be performed from the "right" side 17 of the background fabric 12. Instead, the embroidery is accomplished exclusively from the "wrong" side 18 as shown in FIG. 2.

The punch basically includes an elongated hollow body 20 that includes a longitudinal hollow bore 21. A hollow needle 22 is provided at a lower body end 24. End 24 on the upper body includes an opening 25 therein in coaxial alignment with the bore and hollow interior of the needle.

The body 20 is formed in two separable members 26 and 27. The first member 26 includes a male connector surface 28 that is received by a female connection surface 29 of the second member 27 in an interference fit. First member 26 also includes an additional lower tapered connector surface 30 that is also receivable by the female surface 29 of member 27. Member 27 is longer than the needle so it is possible to entirely encase the needle when the punch is assembled in a storage condition as shown in FIG. 3.

The second member 27 terminates at a rounded shoulder 31 that defines the end of female surface 29. Shoulder 31 provides a finger grip surface against which the embroiderer may pull the punch upwardly to disengage the needle 22 from the background fabric 12. During operation, the punch is held such that the thumb and index finger are engaged with the body 20 at the shoulder 31. When held as such, the end 24 projects upwardly clear of the embroiderer's hand and the needle extends below.

The hollow needle 22 comprises an essential portion of the present invention. It is shown in substantial detail by FIGS. 1, 4 and 5. Basically, the needle includes a blunt upper end 32 that is fixed within the body 20. The upper end 32 openly communicates with the hollow bore 21 of body 20. The hollow interior of the needle 22 extends completely through its length from the upper end 32 to a point 33.

Directly upwardly adjacent the point 33 is an eyelet or aperture 35. It may best be seen in FIGS. 4 and 5. The eyelet is located adjacent to the point 33 so as to be freely accessible from lateral sides of the needle. Thus, as shown in FIG. 5, the eyelet is completely exposed when viewed from the side of the needle including the bevel surface 34. It is important that the eyelet be located in this position to facilitate threading of the embroidery floss or thread through eyelet 35 rather than through the open point 33. Otherwise, it is possible that the floss could be severed by the rearward inside edge **34*a* of the beveled surface 34**.

The tool is ordinarily held in the storage condition as shown in FIG. 3 when it is not in use. In this storage condition, the needle is entirely enclosed by the second member 27 to protect the needle and also to prevent injury to persons handling the needle. In addition, the storage configuration is relatively compact and takes very little space in a sewing or embroidery kit. However, when the tool is assembled as shown in FIG. 1, the two sections come together to form a barrel or holder of sufficient length and cross-sectional dimension to fit comforably in an embroiderer's hand.

In order to thread the tool 10, the user must thread the floss 13 downwardly through the hollow body 20 and through the length of hollow needle 22. This is most easily accomplished through utilization of a very fine wire 38 (FIGS. 1 and 4). The wire 38 is doubled onto itself and pushed from the point 33 longitudinally through the entire length of the assembled tool. The free end of the floss 13 is then threaded through the looped end of the wire 38. The free ends of the wire are then pulled to retract the looped end back through the hollow body and needle, drawing the thread along until the thread end projects downwardly clear of the point 33 as shown in FIG. 4. At this point, the wire loop is used again, only this time it is extended through the eyelet 35 as shown in FIG. 4. The free floss end is again threaded through the exposed loop and the wire again pulled to draw the thread through the aperture. The tool is now ready for use.

The following is given as an example of a single method by which the present tool may be utilized in performing "Russian" embroidery. It is understood however that the tool may be utilized for other methods of embroidery work, patching, applique, monogramming, reverse looping and the like; thus, the specific features of the tool are not restricted to any singular use.

To begin a "Russian" embroidery project, the embroiderer first threads the tool as described in the above paragraphs. A pattern is generally applied or otherwise secured to the "wrong" side of a background fabric.

In beginning, the embroiderer simply punches the needle downwardly through a stretched background fabric (from the "wrong" side 18) until the lower body end 23 engages the taut fabric. Thus, the lower body end 23 functions as a stop to determine the prescribed depth for each successive stitch.

The embroiderer then pulls the needle back out from the hole, using the shoulder 31 for the fingers to pull against. This leaves a loop (FIG. 6) on the "right" side 17 of the background fabric. The loop is comprised of doubled over floss or thread and is equal in length to onehalf the length of the needle protruding from the lower end of body 20. The floss or thread is not pulled back outward of the background material because the frictional engagement between the floss and background material is greater than the frictional engagement between the sides of the needle and background material. Thus, the first loop is formed.

To make the next successive loop, the embroiderer moves or substantially drags the point 33 across the stretched background fabric to a point closely adjacent to the previous point of insertion but closer to the embroiderer. Here again, the needle is punched through the material to the depth of the lower body end 23. It is subsequently withdrawn to form the second loop. As the process continues, a line of stitches is formed on the "wrong" side 18 of the material and a series of loops 39 on the "right" side 17 of the material. If the floss or thread is allowed to freely thread through the needle, there is no problem with the loop formation slipping or being pulled back through the fabric.

When the embroidery work is complete, the pattern is formed on the "right" side of the background fabric. On occasions the embroiderer may desire to cut the formed loops to obtain a "chenille" effect. It is noted that the formation of the successive loops is accomplished in a minimum number of steps that are performed by the embroiderer. That is, each insertion and withdrawal of the needle leaves a perfectly formed loop, where previously as many as two separate stitches had to be made before a single loop was formed.

It may have become obvious from the above description that various changes and modificatons may be made therein without departing from the scope of this invention. Therefore, only the following claims are to be taken as definitions of my invention.

What I claim is:

1. An embroidery tool, comprising:

a hollow elongated body having a female member and a male member that are reversibly frictionally interconnectible;

said male member having a hollow interior extending between a needle receiving end and an open opposite end;

said male member having two exterior surfaces that are oppositely tapered inward toward respective ends of the male member;

an elongated hollow needle mounted to the needle receiving end of the male member in open communication with the hollow interior and projecting longitudinally from the male member a prescribed distance and terminating in a pointed tip;

said needle having a transverse eye formed adjacent the tip communicating with the hollow interior of the needle; and said female member having a thread receiving opening formed in one end thereof communicating with a hollow interior that extends to an opposite end having a tapered female opening formed therein complementary to the tapered exterior surfaces of the male member for frictionally receiving either of the ends of the male member; and said hollow interior of the female member having a length greater than the prescribed distance of the needle to encase the needle in the hollow interior of the female member when the needle receiving end of the male member is received in the tapered female opening of the female member.

2. The embroidery tool as set out in claim 1 wherein the needle tip is pointed on a side thereof having the eye formed therein and wherein the point is formed by a single inclined planar surface leading upward and outward from the tip.

3. The embroidery tool as set out by claim 1 wherein the overall length of the body is sufficient to fit comfortably within a hand of a user with the one end of the female member projecting upwardly clear of the hand and with the needle projecting downwardly clear of the hand.

* * * * *